US008398570B2

(12) United States Patent
Mortimer et al.

(10) Patent No.: US 8,398,570 B2
(45) **Date of Patent: *Mar. 19, 2013**

(54) WIDE BAND VIBRATIONAL STIMULUS DEVICE

(75) Inventors: Bruce J. P. Mortimer, Maitland, FL (US); Gary A. Zets, Maitland, FL (US)

(73) Assignee: Engineering Acoustics, Inc., Casselberry, FL (US)

( * ) Notice: Subject to any disclaimer, the term of this patent is extended or adjusted under 35 U.S.C. 154(b) by 1019 days.

This patent is subject to a terminal disclaimer.

(21) Appl. No.: 12/348,800

(22) Filed: Jan. 5, 2009

(65) Prior Publication Data

US 2009/0200880 A1 Aug. 13, 2009

Related U.S. Application Data

(63) Continuation-in-part of application No. 11/787,275, filed on Apr. 16, 2007.

(60) Provisional application No. 60/792,248, filed on Apr. 14, 2006, provisional application No. 61/009,980, filed on Jan. 4, 2008.

(51) Int. Cl.
*A61H 1/00* (2006.01)

(52) U.S. Cl. ..... 601/46; 601/60; 601/82

(58) Field of Classification Search ..... 601/46, 601/48, 56, 58–60, 66, 67, 71, 72, 78, 82, 601/84

See application file for complete search history.

(56) References Cited

U.S. PATENT DOCUMENTS

| | | | | | |
|---|---|---|---|---|---|
| 2,466,691 | A | * | 4/1949 | Daniels | 346/33 ME |
| 4,076,320 | A | * | 2/1978 | Reiss | 406/32 |
| 4,088,128 | A | * | 5/1978 | Mabuchi | 601/101 |
| 4,513,737 | A | * | 4/1985 | Mabuchi | 601/101 |
| 4,535,760 | A | * | 8/1985 | Ikeda et al. | 601/57 |
| 4,675,907 | A | * | 6/1987 | Itagaki et al. | 381/152 |
| 4,887,594 | A | * | 12/1989 | Siegel | 601/71 |
| 5,300,095 | A | * | 4/1994 | Salazar | 601/21 |
| 5,327,886 | A | * | 7/1994 | Chiu | 607/96 |
| 5,593,381 | A | * | 1/1997 | Tannenbaum et al. | 601/93 |
| 5,676,637 | A | * | 10/1997 | Lee | 601/15 |
| 5,904,660 | A | * | 5/1999 | Kim | 601/108 |

* cited by examiner

*Primary Examiner* — Kristen Matter
(74) *Attorney, Agent, or Firm* — Larry D. Johnson

(57) ABSTRACT

An eccentric mass (EM) motor in a vibrotactile transducer provides a wide band vibrational stimulus to a mechanical load in response to an electrical input. The eccentric mass and motor may form part of the transducer actuator moving mass, which is in contact with a load, i.e, the skin of a user. The moving mass and the actuator housing may be in simultaneous contact with the load. The moving mass may be guided by a spring between the actuator housing and the moving mass. The load, moving mass, spring compliance, and housing mass make up a moving mass resonant system. The spring compliance and system component masses may be configured to maximize the actuator displacement and/or tailor the transducer response to a desired level. This configuration may be implemented as a low-mass wearable wide-band vibrotactile transducer.

20 Claims, 8 Drawing Sheets

Displacement level in micrometers peak, loaded into a skin (body) load

Displacement level in micrometers peak, loaded into a skin (body) load

WIDE BAND VIBRATIONAL STIMULUS DEVICE

CROSS REFERENCE TO RELATED APPLICATIONS

This application is a Continuation-In-Part (CIP) Application of U.S. application Ser. No. 11/787,275, filed Apr. 16, 2007, which claims priority to U.S. Provisional Application No. 60/792,248, filed Apr. 14, 2006, the contents of these applications being incorporated entirely herein by reference. This application also claims priority to U.S. Provisional Application No. 61/009,980, filed Jan. 4, 2008, the contents of which are incorporated entirely herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. N68335-07-C-0258 awarded by the Naval Air Warfare Center.

BACKGROUND OF THE INVENTION

1. Technical Field

The present invention relates generally to vibrators, transducers, and associated apparatus, and more specifically to an improved method and apparatus for generating a wide bandwidth vibrational stimulus to the body of a user in response to an electrical input.

2. Description of Related Art

The sense of feel is not typically used as a man-machine communication channel. However, it is as acute and in some instances as important as the senses of sight and sound. Tactile stimuli provide a silent and invisible, yet reliable and easily interpreted, communication channel using the human sense of touch. Information can be transferred in various ways including force, pressure, and frequency-dependent mechanical stimulus. Broadly, this field is also known as haptics.

Haptic interfaces may be employed to provide additional sensory feedback during interactive tasks. For example computer games make use of portable game consoles that often include various motors and transducers that apply forces to the housing of the console at various vibrational rates and levels. These forces correlate to actions or activities within the game and improve the gaming experience. Similar haptic interface techniques may be employed for a variety of other interface tasks including vibrotactile communication via a flat panel touch screens or mobile device. Vibration feedback may be more intuitive than audio feedback and has been shown to improve user performance with certain devices.

A single vibrotactile transducer may be employed for a simple purpose such as sending an alert, e.g., via a mobile phone. Many interface devices, such as computer interface devices, allow some form of haptic feedback to the user. A plurality of vibrotactile transducers may be employed to provide more detailed information, such as spatial orientation of a person relative to some external reference. Using an intuitive organization of vibrotactile stimuli, information referenced with respect to a user's body (body-referenced) may be communicated to a user. Such vibrotactile displays have been shown to reduce perceived workload by its ease in interpretation and intuitive nature.

Vibrotactile transducers may be wearable, mounted within the padding of a seat back and/or base, or included within the structure of an interface device, such as a PDA or gaming interface. In each case, the vibrotactile transducer preferably provides a sufficiently strong, localized vibrotactile sensation (stimulus) to the body. These devices should preferably be small, lightweight, efficient, electrically and mechanically safe and reliable in harsh environments. Moreover, drive circuitry should be compatible with standard communication protocols to allow simple interfacing with various avionics and other systems.

The study and development of mechanical and/or vibrational stimuli on the human skin has been ongoing. For example, a particular diagnostic device produces and monitors mechanical stimulation against the skin using a moving mass contactor termed a "tappet" (plunger mechanical stimulator). A bearing and shaft links and guides the tappet to the skin, and an electromagnetic motor circuit provides linear drive, similar to that used in a moving-coil loudspeaker. The housing of the device is large and mounted to a rigid stand and support, and only the tappet makes contact with the skin. The reaction force from the motion of the tappet is applied to a massive object such as the housing and the mounting arrangement. The device was developed for laboratory experiments and is not intended to provide information to a user by means of vibrational stimuli or to be implemented as a wearable device.

Various other types of vibrotactile transducers that provide a tactile stimulus to the body of a user have been produced. Other vibrotactile transducers designs have incorporated electromagnetic devices based on a voice coil (loudspeaker or shaker) design, an electrical solenoid design, or a simple variable reluctance design. The most common approach is the use of a small motor with an eccentric mass rotating on the shaft, such as is used in pagers and cellular phones. A common shortcoming of these previous design approaches is that the transducers are rapidly damped when operated against the body, usually due to the mass loading of the skin or the transducer mounting arrangement.

Eccentric mass (EM) motors, e.g., pager motors, are usually constructed with a DC motor with an eccentric mass load, such as half-circular cylinder that is mounted onto the motor's shaft. The motor is designed to rotate the shaft and its off-center (eccentric) mass load at various speeds. From the conservation of angular momentum, the eccentric mass imparts momentum to the motor shaft and consequently the motor housing. The angular momentum imparted to the motor housing depends on the mounting of the motor housing, the total mass of the motor, the mass of the eccentric rotating mass, the radius of the center of mass from the shaft, and the rotational velocity. In steady state, the angular momentum imparted to the housing results in three dimensional motion and a complex orbit that depends on the length of the motor, the mounting geometry, the length of the shaft, and center of gravity of the moving masses. This implementation applies forces in a continually changing direction, confined to a plane of rotation of the mass. Thus, the resultant motion of the motor housing is three dimensional and complex. If this motion is translated to an adjacent body, the complex vibration (and perceived vibrational stimulus) may be interpreted to be a diffuse "wobble" sensation.

The rpm of the EM motor defines the tactile frequency stimulus and is typically in the range of 60-150 Hz. These devices are generally intended to operate at a single (relatively low) frequency, and cannot be optimized for operating over a wide frequency range or at sufficiently high frequencies where the skin of the human body is most sensitive to vibrational stimuli. It may be possible to increase the vibrational frequency on some FM motors by increasing the speed of the motor (for example, by increasing the applied voltage to a DC motor). However, there are practical limits to this approach, as the force imparted to the bearing increases with rotational velocity and the motor windings are designed to support a maximum current. The angular momentum and therefore the eccentric motor vibrational output (and force) also increase with rotational velocity which limits use of the device over bandwidth. In fact, in some designs, the force and rotational rate are coupled and cannot be separated.

The temporal resolution of EM motors is limited by the start up (spin-up) times which can be relatively long, e.g., on the order of about 100 ms. This is somewhat longer than the temporal resolution by the skin, and thus, can limit data rates. If the vibrotactile feedback is combined with other sensory feedback such as visual or audio, the start-up delay has the potential of introducing disorientation. The slow response time needed to achieve a desired rotational velocity is due the acceleration and deceleration of the spinning mass. Some motor control methods can address this problem by increasing the initial torque when initially turned on. Motors with smaller eccentric masses may be easier to drive (and reduce spin-up time), but thus far a reduced eccentric mass also results in an actuator that produces a lower vibrational amplitude.

There are two important effects associated with the practical operation of EM motors as vibrotacile or other transducers. Firstly, the motion that is translated to an adjacent body depends on the loading on the motor housing. From the conservation of momentum, the greater the mass loading on the motor (or transducer housing) the lower the vibrational velocity and perceived amplitude stimulus. Secondly, from the conservation of momentum, if the mass loading on the motor is changed, the torque on the motor and angular rotation rate also changes. This may be undesirable from a control standpoint, and in the limiting case, a highly loaded transducer may produce minimal displacement output and thus be ineffective as a tactile stimulus. In fact, there have been several reports of inconsistency in results which may be attributed to the shortcomings of other designs and modeling attempts to overcome this using complex mounting.

In one system, a computer mouse haptic interface and transducer uses a motor transducer. A mechanical flexure system converts rotary force from the motor to allow a portion of the housing flexure to be linearly moved. This approach relies on a complex mechanical linkage that is both expensive to implement and at high rotational velocities prone to deleterious effects of friction. It is therefore only suited to very low frequency haptic feedback.

In another system, a mechanically movable eccentric mass is employed in an effort to control the start-up and force characteristics of an eccentric mass motor. However, this approach is mechanically complex and not intended to be wide band.

In yet another system, an EM motor is connected to the housing via a compliant spring. The system makes up a two degree of freedom resonant mechanical system. The motor mass and spring systems are completely contained within a rigid housing. The movement of the motor mass in this case acts to impart an inertial force to the housing. This type of transducer configuration is known as a "shaker." The design claims improved efficiency and the ability to be driven by a harmonic motor drive for use as a haptic force feedback computer interface. The system does not address any loading on the housing and in fact assumes that there are no other masses or mechanical impedances acting on the exterior of the housing. Further, this design is narrow band thereby limiting the effectiveness and use of this approach.

Employing linear "shaker" transducers, another system employs a low frequency vibrator with a reciprocating piston mass within a low friction bearing, actuated by an electromagnetic with a magnetic spring, having a spring constant K. The ratio of K to the mass M of the reciprocating member is made to be resonant in the operating frequency range of the vibrator.

SUMMARY OF THE INVENTION

When used in vibrotactile transducers, eccentric mass (EM) motors provide a mounting dependent vibration stimulus and a diffuse type sensation, so that the exact location of the stimulus on the body may be difficult to discern. As such, they might be adequate to provide a simple alert, such as to indicate an incoming call on a cellular phone, but would not be adequate to reliably provide spatial information by means of the user detecting stimuli from various sites on the body. Most systems fail to recognize the design requirements for achieving a small, wearable vibrotactile device that provides strong, efficient vibration performance (displacement, frequency, force) when mounted against the skin load of a human. This is particularly true when considering the requirement to be effective as a lightweight, wearable tactile display (e.g., multiple vibrotactile devices arranged on the body) in a high noise/vibration environment as may be found, for example, in a military helicopter. Further, the effect of damping on the transducer vibratory output due to the additional mechanical impedance coupled to the mounting has not been adequately addressed. Most systems fail to effectively utilize an eccentric mass motor as the force generator in vibrotactile transducers or provide methods that extend the frequency bandwidth and control the response of the transducer.

Accordingly, embodiments according to aspects of the present invention provide a novel implementation of a low-cost, wide-bandwidth vibrotactile transducer employing an EM motor. In some embodiments, the EM motor forms part of the moving mass of the transducer actuator, or mechanical contactor. The moving mass is in contact with a skin (body) load. The moving mass may be constrained into approximately vertical motion (perpendicular to the skin surface) by a spring between the actuator housing and moving mass. The rotational forces provided by an eccentric mass (EM) motor may therefore be limited to predominantly one dimensional motion that acts perpendicularly against a skin (body) load. The contacting face of the actuator housing may be in simultaneous contact with the body load (skin). The body load, actuator moving mass, spring compliance and housing mass make up a moving mass resonant system. The spring compliance and system component masses may be configured to maximize the actuator displacement while minimizing the housing motion and to tailor the transducer response to a desired level.

For wide band operation, the spring compliance may be chosen together with the system component masses, loading and dimensions, such that the resonance occurs at or below the desired operating frequency, typically operating the transducer at frequencies above resonance. An EM motor produces an inertial force proportional to the size of the eccentric mass and the rotational velocity squared. In one embodiment, the EM motor force generator is combined with a mass-spring mechanical resonant oscillator as a transducer configuration. The mechanical oscillator is a well known combination of at least one moving mass and a spring. When operating above the mechanical oscillator resonance frequency, the moving mass characteristic velocity attenuates proportional to frequency. This results in a beneficial shaping of the EM motor force characteristics and an overall system displacement response that is relatively flat over a wide operating frequency range.

This configuration may, for example, be implemented as a low mass wearable vibrotactile transducer, as a haptic push-button or touch screen display, or as a transducer that is mounted within a soft material such as a seat or within the in-sole of a shoe, and is intended to convey vibration to the body adjacent to the transducer. A particular advantage of this configuration is that the moving mass motion can be made almost independent of force loading on the transducer housing.

The method and apparatus for generating a vibrational stimulus of this invention provides an improved small, low cost vibrotactile transducer to provide a controllable strong tactile stimulus that can be easily felt and localized by a user involved in various activities, for example driving a car, flying an aircraft, playing a video game, walking, interacting with a display, or performing an industrial work task. Due to the high amplitude and point-like sensation of the vibrational output, the inventive vibrotactile transducer ("tactor") can be felt and localized at various positions on the body, and can provide information to the user. The transducer itself may be a small package that can easily be located against the body when installed under or on a garment, or on the seat, within an insole, display device, or back of a chair. The drive electronics are compact, able to be driven by batteries, and follows conventional motor driver control techniques. The overall transducer may include interface circuitry that is compatible with digital (e.g., TTL, CMOS, or similar) drive signals typical of those from external interfaces available from computers, video game consoles, and the like.

A number of the transducer drive parameters can be varied. These include vibrational displacement amplitude, drive frequency, modulation frequency, and wave-shape. In addition single or groups of transducers can be held against the skin, in various spatial configurations round the body, and activated singly or in groups to convey specific sensations to the user.

Therefore, embodiments according to aspects of the present invention may provide a new and improved method and apparatus for generating a wide-band vibrational stimulus to the body of a user. Embodiments may further provide a new and improved low cost vibrotactile transducer and associated drive controller electronics. Embodiments may also provide a new improved eccentric mass motor transducer that has a vibrational displacement output that is substantially uniform in transducer displacement over a wide frequency band of interest. Other embodiments may provide a new and improved transducer that is integrated into the mechanism of a push button switch or screen display, to provide enhanced haptic and tactile information to the finger or hand of a user. Further embodiments may provide a new and improved transducer that can easily be located against the body when installed under or on a garment, within the insole of a shoe, or on the seat or back of a chair.

Other novel features which are characteristic of the invention, as to organization and method of operation, together with further objects and advantages thereof will be better understood from the following description considered in connection with the accompanying drawings, in which embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. Further the following description may describe any combination of spring and/or bearing as a suspension mechanism.

DETAILED DESCRIPTION OF THE INVENTION

Figure 1:
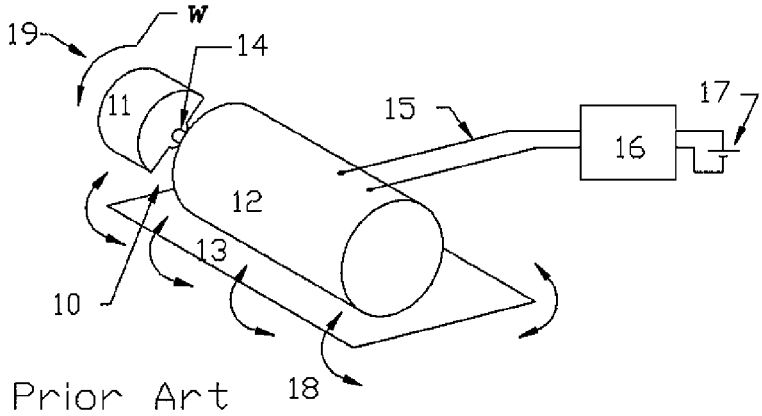
FIG. 1 illustrates a prior art eccentric mass motor transducer, associated controller, and driver electronics.

FIG. 1 illustrates the operation of prior art eccentric mass (EM) motor 10. An eccentric mass 11 is mounted on a shaft 14 driven by a motor 12 that is mounted on a base 13. The motor may be a DC motor although various synchronous, stepper, variable reluctance, ultrasonic, and AC motors, or the like, may be used. The motor 12 is connected to a controller unit 16 by wires 15. The controller unit 16 is powered with a power supply 17, such as a battery. The controller unit 16 may contain or be connected to, additional processing hardware and/or software (depending on the vibrotactile application). The controller unit 16 may also contain the necessary electronic topology for powering and controlling the motor 12. The eccentric mass 11 may be a half-circular cylinder, or similarly shaped device where the center of mass is not the same as the center of rotation, i.e., off-center mass load. The center of rotation is determined by the shaft 14. The motor is designed to rotate the shaft 14 and the eccentric mass 11 at various rotational velocities 19. From the conservation of angular momentum, the eccentric mass 11 imparts momentum to the motor shaft 14 and consequently the motor housing and base 13. The angular momentum imparted to the motor housing depends on the geometry of the motor 12 and base 13, the total mass of the motor 12, the mass of the eccentric rotating mass 11, the radius of the center of mass from the shaft 14, the length of the shaft 14, and the rotational velocity 19. If the motor 12 is mounted on a compliant base 13, the steady state angular momentum imparted to the housing will result in an eccentric orbit. This implementation applies forces in a continually changing direction confined to a plane of rotation of the mass, providing a "wobble" or rocking vibration 18.

The force output from an EM motor is given by:

$$F_{Radial}=M_E r_E \omega^2$$

where $M_E$ is the eccentric mass, $r_E$ is the radius to the center of gravity (COG) of the eccentric mass, and $\omega$ is the angular frequency determined by the motor rotation. Thus, an EM motor produces an inertial force proportional to the size of the eccentric mass and the rotational velocity squared. In addition, the force or displacement output is not constant with frequency. Furthermore, the eccentric mass inertia is more difficult to rotate at higher rpm.

Figure 2:
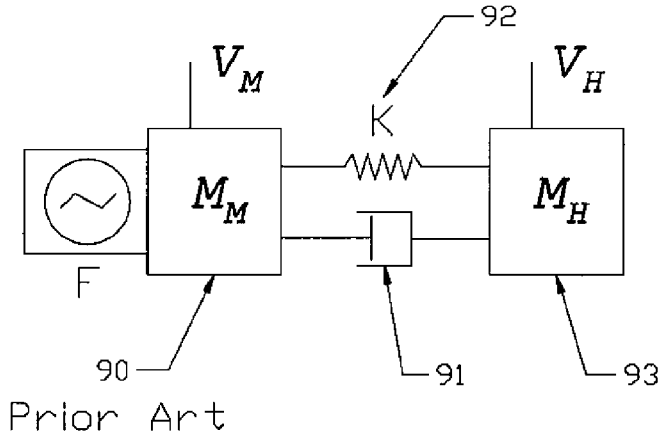
FIG. 2 illustrates a free-body diagram of a prior art configuration relating to the transmission of inertial forces produced by an inertial actuator (EM motor and spring) on the housing of a tactile feedback device.

FIG. 2 shows a free-body diagram of a prior art configuration that attempts to increase the transmissibility of inertial forces produced by an inertial actuator. The EM motor 90 acts on a compliant spring 92 and damping element 91 with a reaction mass from the housing 93. The spring and mass of the motor are chosen to be resonant in a band where inertial forces are desired to be maximum. This configuration is known as a shaker as the inertial mass (EM motor 90) oscillates at a velocity Vm internal to the housing of the actuator. The housing 93 vibrates with a velocity $V_H$. The force imparted to the housing 93 will depend on the mass of the housing $M_H$ compared to the EM motor mass $M_M$. In fact, the housing mass $M_H$ may be sufficiently large to reduce the additional loading and reduction in force that would result from the practical mounting of the transducer and/or the mechanical impedance associated with a skin load. A severe shortcoming, however, occurs when such designs need to be extended to wearable transducer systems where the overall mass of the complete transducer (and housing) should be kept as low as possible. Furthermore, mounting these transducer designs, for example, within a viscous foam material found in the padding of a seat or against the skin of a body loads the surface of the complete transducer housing with mechanical damping. Such damping decreases the force and vibrational output to low levels and severely limits the efficiency of these designs. In addition, these designs do not address wide band operation, as their operation is determined by the mechanical resonant characteristics of the masses $M_M$ and $M_H$, spring 92, and damper 91, resulting in a very limited frequency range.

Figure 3:
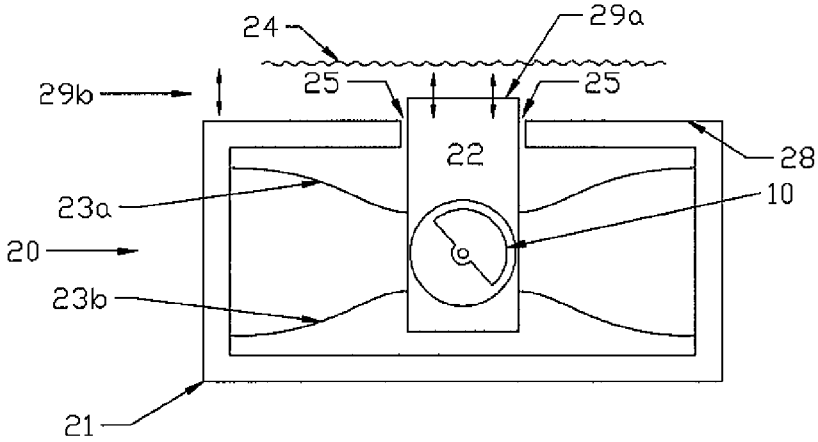
FIG. 3 illustrates an embodiment of a vibrotactile transducer according to aspects of the present invention.

FIG. 3 illustrates an embodiment of an eccentric mass motor vibrotactile transducer 20 according to aspects of the present invention. The embodiment provides a lightweight, compact, low-cost, and electrically-efficient vibrotactile transducer 20 that applies a localized sensation on a body surface 24 associated with a user. The surface 24 may be a skin surface, with or without intermediate layers of clothing. The vibrational output is independent of the loading effects of a housing or the surface 24. Various types of information may be communicated to a user in an intuitive, body referenced manner by employing one or more vibrotactile transducers 20 and varying or modulating the signal from each of the vibrotactile transducers 20. A controller and driver electronics (not shown) may be employed to operate the vibrotactile transducer 20.

As shown in FIG. 3, in response to an electrical input, the vibrotactile transducer 20 produces a vibrational output 29*a* by causing a mechanical contactor 22 to move perpendicularly against a load associated with the surface 24. The contactor 22 protrudes through an opening 25 in a front contacting face 28 of a housing 21 of the vibrotactile transducer 20. The front contacting face 28 and contactor 22 may therefore be in simultaneous contact with the surface 24.

An EM motor 10 is used as the force actuator in the vibrotactile transducer 20. The EM motor 10 is coupled to the contactor 22. In particular, the EM motor 10 may be mounted within a machined opening in the contactor 22. The contactor 22 is also coupled to the walls of the housing 21 via a set of compliant springs 23*a* and 23*b*. The total combinational spring compliance is specially chosen, e.g., to be resonant with the mass elements in the system (including the mechanical impedance elements contributed by the load corresponding to the surface 24). The springs 23*a* and 23*b* may also be chosen to have characteristics that limit the motion of the contactor 22 to predominantly vertical displacement, i.e., the lateral compliance is much lower than the vertical spring compliance. These characteristics can, for example, be achieved by a pair of disc shaped planar springs as described further below.

It may be preferable to have the front contacting face 28 of the housing 21 and the contactor 22 are held in simultaneous contact with the surface 24. The contactor 22 may be the predominant moving mass in the system, providing vibratory motion 29*a* perpendicular to the skin and consequently delivering a vibrotactile stimulus to the surface 24. The housing 21 and front contacting face 28 are allowed to vibrate at a reduced level 29*b* and substantially out of phase with the contactor 22 as described further below. To account for the elasticity of the surface 24 and/or the layers of clothing between the contactor 22 and the surface 24, the mechanical contactor 22, in its rest position, is raised slightly above the front contacting surface 28 of the housing 21. The height of the contactor 22 relative to the housing contacting surface 28, and the compliance of the springs 23*a* and 23*b* are chosen so that when the housing 21 and contactor 22 are pressed against the surface 24, the contactor 22 and EM motor 10 assembly are displaced with respect to the housing 21 to simultaneously pre-load the contactor 22 against the surface 24 and the contactor/EM motor assembly against the action of the springs 23*a* and 23*b*. In one embodiment, the height of the contactor 22 relative to the front surface 28 is about 1 mm for appropriate bias preload against the surface 24.

In designing a practical and wearable embodiment, the overall mass of the transducer may be small, e.g, less than 50 g. This overall mass includes the mass of the contactor 22, the EM motor 10, and the housing 21. The housing 21 should be robust and should facilitate mounting onto a belt, seat, clothes and the like.

Figure 4:
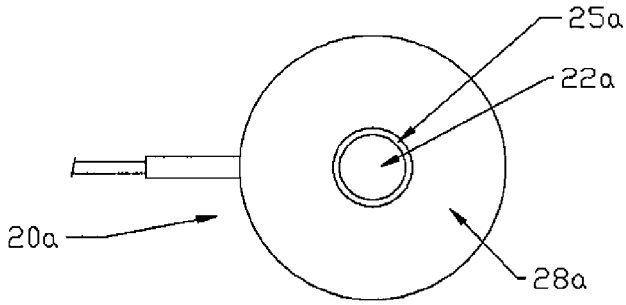
FIG. 4 illustrates the contactor, a radial gap surrounding the contactor, and the housing/surround plate for an embodiment of a vibrotactile transducer according to aspects of the present invention.

FIG. 4 illustrates a vibrotactile transducer 20*a* including other aspects of the present invention. A front contacting face 28*a* of the housing and a front contacting face of the mechanical contactor 22*a* may be in simultaneous contact with the body surface, e.g., skin surface (not shown). A radial gap 25*a* is formed when the contactor 22*a* is disposed within the opening 25*a* of the housing of the vibrotactile transducer 20*a*. In this configuration, the front contacting face 28*a* of the housing in contact with the body surface acts as a "passive surround" that mechanically blocks the formation of surface waves that would otherwise radiate from the front contacting face of the mechanical contactor 22*a* on the body surface when the contactor 22*a* is oscillated perpendicularly against the body surface. Advantageously, the effect of the motion of the contactor 22*a* may be restricted to an area closely approximated by the area size of the face of the mechanical contactor 22*a*, thus localizing the vibrotactile sensation. In one embodiment, the radial gap 25*a* may be approximately 0.030 inches and provides a sharper delineation between vibrating and non-vibrating skin surfaces, further improving tactile sensation and localization. In addition, the front contacting face 28*a* of may prevent abnormal loading that may otherwise restrict the motion of the contactor 22*a*.

Figure 5:
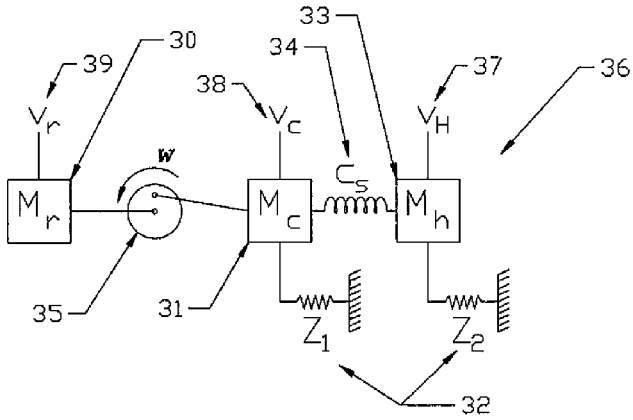
FIG. 5 illustrates a free-body diagram of a transduction model for an embodiment of a vibrotactile device according to aspects of the present invention.

A transduction model for the transducer 20 is shown in the free-body diagram 36 of FIG. 5. In particular, the model of the vibrotactile transducer 20 shown in FIG. 5 includes dual moving masses: the rotating mass ($M_r$) 30 for the EM motor 35 and the contactor mass ($M_c$) 31 for the mechanical contactor. The system includes components of a mass-spring, force-actuator mechanical resonant system. In mechanical resonant systems, the ratio of the moving mass $M_c$ and the spring constant $K_r$, are used to determine the square of the resonance frequency (for the actuator operating in the absence of loading, e.g., as if the contactor were moving freely in air). The loading effect of the surface 24 against the contactor 22 and housing 21 as shown in FIG. 3 are included in the model of FIG. 5. A mechanical impedance 32 corresponds with the loading effect and is related to mechanical parameters described further below.

The EM motor 35 shown in FIG. 5 rotates at ω rad/s and acts on the eccentric load mass 30 and produces a reaction force corresponding to the contactor mass 31. The EM motor 35 is the actuator or force driver for the system. The contactor mass 31 is the total moving mass corresponding to the contactor assembly. The eccentric load mass 30 is unconstrained in the system and is free to rotate. The contactor mass 31 acts upon the body surface through lumped mechanical impedance $Z_1$ and the housing mass ($M_h$) 33 via a spring compliance ($C_s$) 34. The housing mass 33 also acts on a lumped mechanical impedance $Z_2$ corresponding to the body surface. Typical numerical values for the skin impedance components can be found in E. K. Franke, *Mechanical Impedance Measurements of the Human Body Surface*, Air Force Technical Report No. 6469, Wright-Patterson Air Force Base, Dayton, Ohio, and T. J. Moore, et al., *Measurement of Specific Mechanical Impedance of the Skin*, J. Acoust. Soc. Am., Vol. 52, No. 2 (Part 2), 1972, the contents of which are incorporated herein by reference. Skin tissue has the mechanical input impedance of a fluid-like inertial mass, a spring-like restoring force, and a viscous frictional resistance. The numerical magnitude of each component in the skin impedance depends on the area of the mechanical contactor or housing contacting face. The resistive loading of the skin increases with increasing mechanical contactor (or housing contacting face) diameter.

The load mechanical impedance 32 in certain configurations may also be influenced by the transducer mounting and any intermediate layers between the transducer and the body surface. In this case, values for the mechanical impedance may have to be empirically measured.

FIG. 5 further illustrates a velocity (Vh) 37 for the housing, a contactor velocity (Vc) 38, and a component (Vr) 39 of the eccentric mass velocity. The total suspension spring 23*a* and 23*b* as shown in FIG. 3 is represented by the mechanical compliance 33. The system of masses and mechanical interconnections makes up a multiple-mass resonant system. The masses 30, 31, and 33 may be chosen together with the compliance 34 and loading 32 ($Z_1$ and $Z_2$) to achieve resonance at a selected frequency. This frequency may be the operating frequency for maximum contactor velocity 38 (or displacement), or some other selected frequency to shape the overall transducer vibration response over a wider bandwidth as described further below. It may be desirable to maximize the mechanical contactor velocity 38 while simultaneously minimizing the velocity of the housing 38.

The equations of motion for this mechanical circuit may be solved using electro-acoustic analogous circuit design techniques. The load impedance 32 is assumed to be acting on both the housing and the contactor. Thus, complex mechanical properties of the skin, complete mechanical vibrotactile system components, and motional parameters may be described with this set of equations.

The sensitivity of the bodies skin receptors to vibrational displacement is described, for example, in Bolanowski, S., Gescheider, G., Verrillo, R., and Checkosky, C., "Four channels mediate the mechanical aspects of touch," *J. Acoust. Soc. Am.,* 84(5), 1680-1694 (1988), and Bolanowski, S., Gescheider, G., and Verrillo, R., "Hairy skin: psychophysical channels and their physiological substrates," *Somatosensory and Motor Research,* 11(3), 279-290. (1994), the contents of which are incorporated entirely herein by reference. Three receptor systems are thought to contribute to detection of vibrotactile stimuli at threshold under normal conditions, Pacinian corpuscles (Pc), Meissner's corpuscles, and Merkel's disks. Of these, the Pacinian corpuscles are the most sensitive. At 250 Hz, the sensitivity of the human skin to displacement is less than 1 μm (Pc). In certain applications such as tactile alerts, it may therefore be desirable to arrange the resonance of the transducer to be within a range 150 to 300 Hz to make use of the skin's sensitivity to vibration in this region. Other applications such as haptic or biomedical may require a transducer resonance at a much lower frequency.

Mechanotransduction is the process by which displacement is converted into action potentials. Pc receptors are located relatively deeply within the skin structure. In this range, the human perception of vibration depends primarily on mechanical contactor displacement, and is most sensitive to displacement that is normal to the skin surface (as opposed to tangential or shear). It may therefore be preferable to employ displacement that is predominantly normal to the skin surface as has been described previously. Typically, the displacement may be predominantly normal to the housing.

Figure 6:
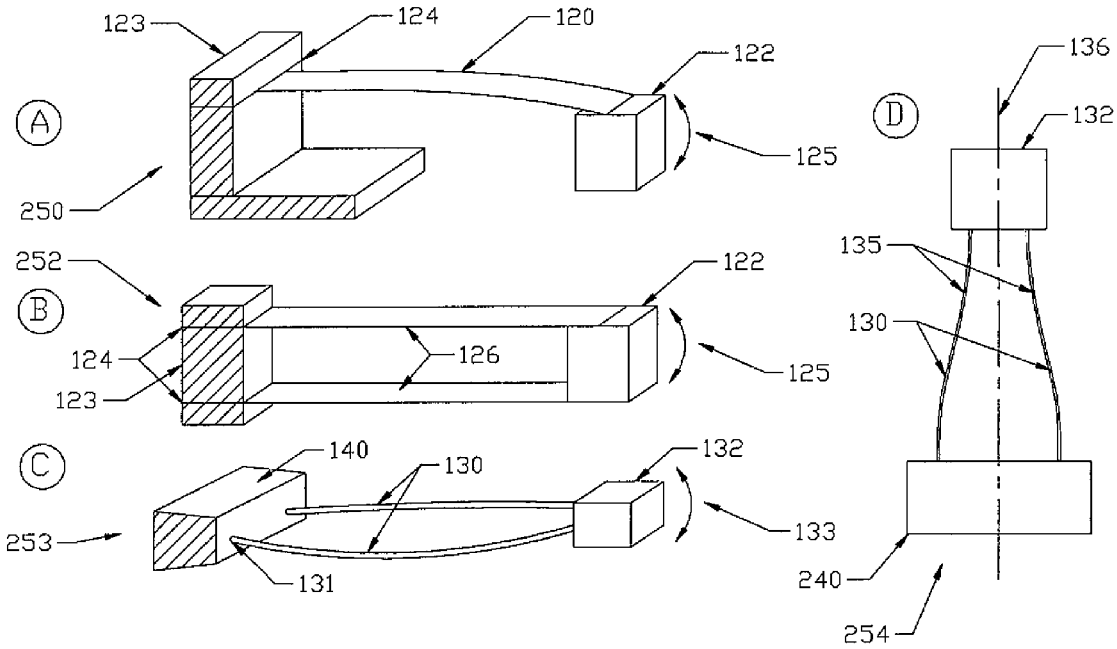
FIG. 6A-6D illustrates various embodiments of a cantilever spring that may be used in embodiments of a transducer apparatus according to aspects of the present invention.

FIG. 6A illustrates an assembly 250 including a single cantilever spring 120 that may be employed in embodiments of the vibrotactile transducer according to aspects of the present invention. A proximal end of the spring 120 is mounted against a fixed housing 123 using a compressive fixture 124 to clamp the spring 120. A mass 122, i.e., the moving mass of the system, is mounted on the distal end of the spring 120. The mass 122 corresponds with the EM motor and the contactor as described previously. The spring 120 may be designed with a suitable material (such as spring steel) to have a thickness d and a spring constant k. Combining these characteristics with the mass 122 results in a spring system resonant frequency approximately given by:

$$\omega_{Resonance} = d\left(\frac{k}{m}\right)^{1/2}$$

The mass 122 oscillates in a radial arc depicted by the arrow 125. For small displacements, this arc may be approximated to be linear. The spring 120 width, length, and thickness can be chosen to have a compliance that is greatest in the direction of the intended vibration 125, while being stiff in the lateral direction.

FIG. 6B illustrates another assembly 252 including a dual cantilever springs 126 that may be employed in embodiments of the vibrotactile transducer according to aspects of the present invention. Proximal ends of two similar springs 126 are mounted against a fixed housing 123 using two compressive fixtures 124 to clamp the springs 126. A mass 122 that corresponds to the moving mass of the system is mounted on the distal ends of the springs 126. The mass oscillates in a radial arc depicted by the arrow 125. In this multiple spring system, the springs 126 are in parallel and the spring constants increase the stiffness of the system. This configuration also has lateral rigidity and the highest compliance in the direction of the intended vibration 125.

FIG. 6C illustrates a further assembly 253 including dual cantilever springs 130 that may be employed in embodiments of the vibrotactile transducer according to aspects of the present invention. Proximal ends of two similar wire springs 130 are mounted against fixed housing 140 using two compressive fixtures 131 to clamp the springs 130. A mass 132 that corresponds to the moving mass of the system is mounted on the distal ends of the springs 130. The mass will oscillate in a radial arc depicted by the arrow 133. In this multiple spring system, the springs 130 are in parallel and the spring constants increase the stiffness of the system. This configuration also has lateral rigidity and the highest compliance in the direction of the intended vibration 133. For a given moving mass 132, housing 140, and mounting configuration 131, the spring characteristics can be changed by selecting various wire diameters, wire materials, and wire spring lengths.

FIG. 6D illustrates yet another assembly including cantilever springs 130 that may be employed in embodiments of the vibrotactile transducer according to aspects of the present invention. Proximal ends of two similar wire springs 130 are clamped in a housing 240. A mass 132 that corresponds to the moving mass of the system is mounted on the distal ends of the springs 130. The mass oscillates perpendicular to an axis 136 shown in FIG. 6D. FIG. 6D shows that the distance between the springs at the moving mass 132 should be smaller than the distance between the springs 130 measured at the housing 240. By way of example, a suitable vibrotactile transducer that uses this cantilever spring assembly embodiment may have a spring length of about 1.1 inches, a distance of about 0.1 inches between the springs 130 at the moving mass 132, and a distance of about 0.7 inches at the housing 140 attachment. The shape of the springs should also preferably show a curve inflection 135 close to the moving mass end. These features stabilize the spring system 154 assembly in a lateral direction and provide a high compliance in the direction of vibration.

Figure 7:
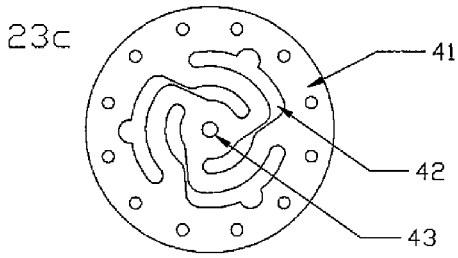
FIG. 7 illustrates a planar spring, mass and spring mounting that may be used in embodiments of a transducer apparatus according to aspects of the present invention.

FIG. 7 illustrates a planar "leaf" spring 23*c* that may be employed in embodiments of the vibrotactile transducer according to aspects of the present invention. The circular planar spring 23*c* provides low compliance (high stiffness) in a plane parallel to the spring, and a high compliance (low stiffness) in a plane perpendicular to the spring. The spring is formed from a flat sheet 41 manufactured with a spacing 42 and a center hole 43. The spring 23*c* serves as a suspension mechanism to position the motor and mechanical contactor assembly concentric to the housing assembly, and provide a controlled mechanical compliance in the perpendicular direction (direction of motion) so that when the mechanical contactor and housing is pressed against the body surface, the mechanical contactor is displaced with respect to the housing to simultaneously pre-load the mechanical contactor against the skin and the contactor/motor assembly against the action of the spring. The compliance of the spring in the perpendicular direction also serves to set the mechanical resonance frequency of the transducer when applied to the skin, as described previously. The circular planar spring also serves to constrain the displacement of the mechanical contactor (including the EM motor) to the perpendicular direction.

Figure 8A:
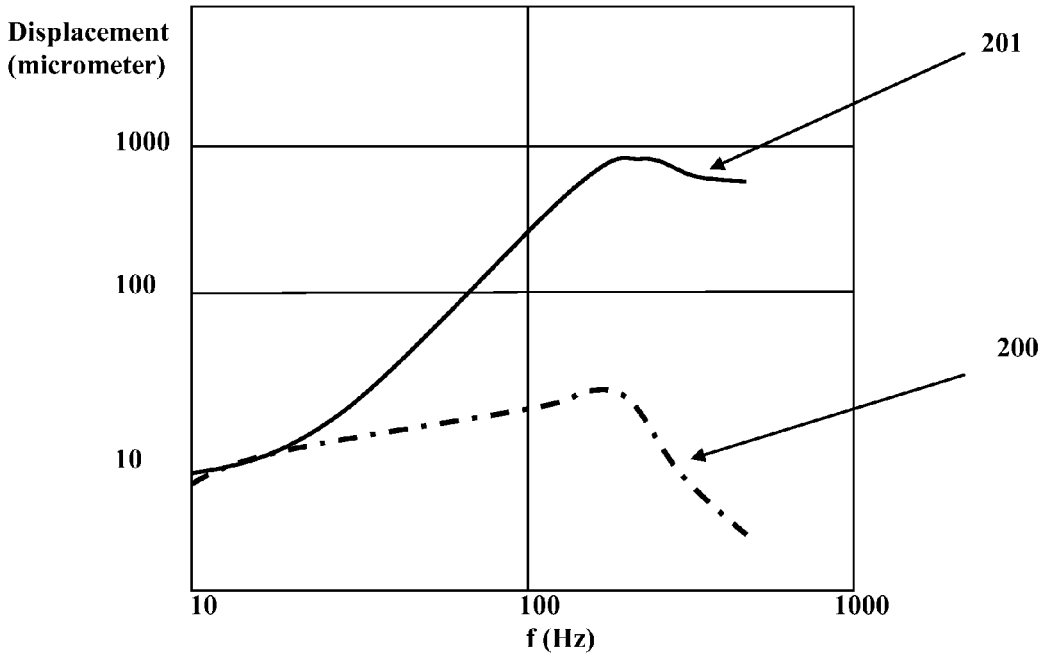
FIG. 8A illustrates a graph of the performance of an embodiment of a vibrotactile transducer according to aspects of the present invention.
Figure 8B:
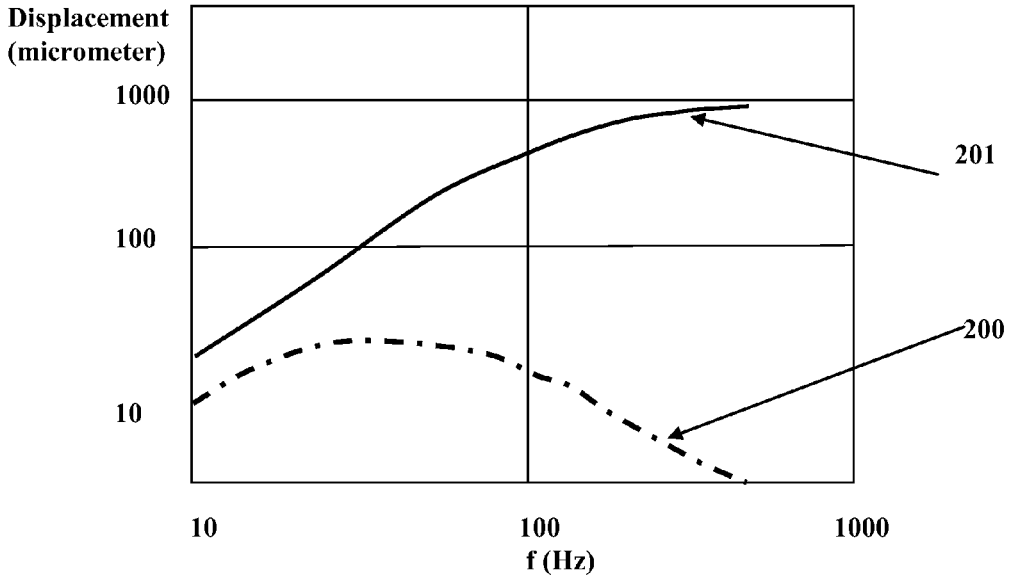
FIG. 8B illustrates another graph of the performance of an embodiment of a vibrotactile transducer according to aspects of the present invention, where according to aspects of the present invention, where the spring has a higher compliance than that chosen for the configuration of FIG. 8A FIGS. 9A-C illustrate the vibrotactile transducer of FIG. 3 in various stages of reciprocating motion according to aspects of the present invention.

FIG. 8A and FIG. 8B illustrate graphs of the contactor and housing velocities vs. frequency for two embodiments based on a computer simulation solving the equations of motion for the mechanical system described previously with reference to FIGS. 3 and 5. The housing mass is chosen to be 25 grams. The mechanical contactor mass (including the EM motor) is 3.5 grams. The diameter of the mechanical contactor is 1 cm. The housing front contacting face is 2.5 cm. The EM motor is swept through a range of angular frequencies, and the relative housing and contactor velocities and displacement are calculated for the condition of a skin loading on the housing and the contactor. The curve 200 corresponds to the data associated with the housing, and the curve 201 corresponds to the data associated with the contactor.

In FIG. 8A, the compliance of the springs is 6.6 $10^{-4}$ m/N. The output response shows high vibrational mechanical contactor displacement in the range of 100-300 Hz. In an aspect of the present invention, the vibrational displacement of the housing surface may be limited as shown by the dashed curve 200. The transducer output vibratory characteristics can be designed by varying the characteristics of the EM motor and the mechanical elements, e.g., contactor mass and area, housing mass and area, and spring compliance. Usually the characteristics of the EM motor are determined in advance, e.g., with size, cost, and motor performance as the selection criterion. The contactor diameter, housing area, mass and spring compliance may be chosen by solving or simulating the resultant equations of motion for the complete transducer over a range of frequencies. The output vibratory displacement for the contactor as shown by curve 201 may be maximized (by iteration and parameterization of the variables) within a frequency range, preferably within 10 to 300 Hz. Additional damping may also be optionally added to the system through the use of dissipative materials (for example foams) that are added to the spring mechanical element and contactor within the vibrotactile transducer.

In FIG. 8B, the compliance of the springs is 0.018 m/N. The output response shows high vibrational mechanical contactor displacement in the range 30-130 Hz (i.e. a lower operating ranging than shown in FIG. 8A). The housing displacement velocity 200 falls off as frequency increases.

FIGS. 8A-B illustrate that at frequencies below resonance, the response is dominated by the stiffness of the spring, and at frequencies above resonance the displacement response is approximately flat. The characteristics of a simple mechanical oscillator have been described in several reference texts, such as T. Hueter and R. Bolt, *Sonics—Techniques for the use of sound and ultrasound in engineering and science*, Wiley (1955), pp. 9-20, the contents of which are incorporated entirely herein by reference. At frequencies below resonance the displacement response is proportional to the force/k (where k is the spring constant). At resonance a simple mechanical oscillator is resistance (or damping) controlled. Above resonance, the mass controlled system has a displacement that falls off proportional to the inverse of frequency squared. As explained previously, the force from an EM motor is proportional to frequency squared. Thus, combining the response of the mechanical oscillator circuit and the drive force from the EM motor (as shown in FIG. 3) results in resultant displacement response that is relatively flat. The limit on this behavior occurs when, at higher frequencies, multiple modes occur in the springs or the motor speed limit is reached.

However, as will be understood from the foregoing explanation and the graphs of FIGS. 8A-B, the condition of pervasive displacement response can exist over a quite substantial frequency range, e.g. over two octaves. Not only is this useful range substantially greater than that available with other systems, the physical configuration of the vibrotactile transducer is well-suited for wearable use as described previously.

Figure 9:
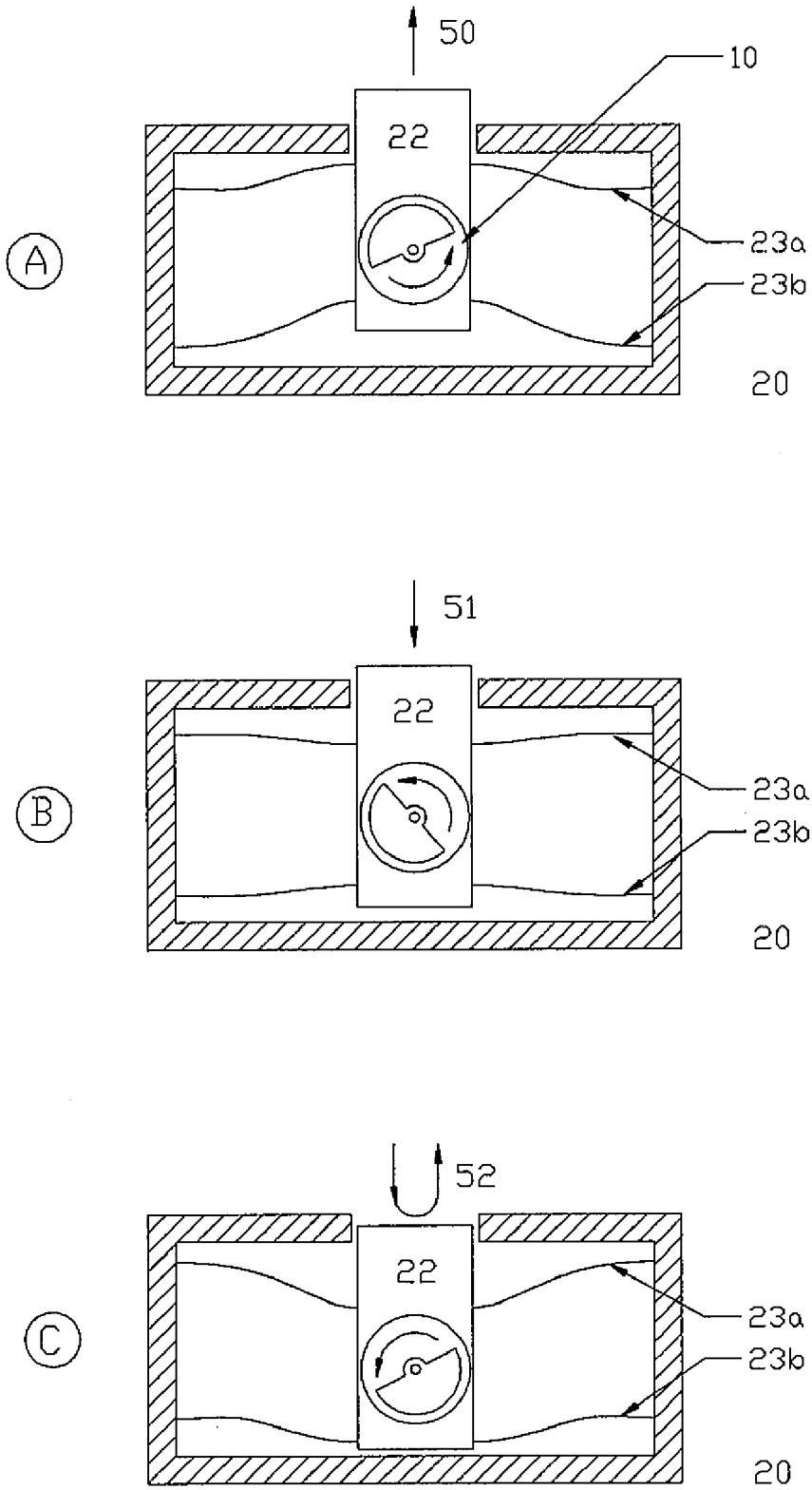

FIGS. 9A-C illustrate the vibrotactile transducer 20 of FIG. 3 in various stages of reciprocating motion. The eccentric mass (EM) motor 10 is connected to a suitable external power source and controller electronics (not shown) which causes the motor shaft and eccentric mass load to rotate. As shown in FIG. 9B, from the conservation of angular momentum, and the centering action of the spring elements 23*a* and 23*b*, the mechanical contactor 22 moves about the neutral 51 position. On the positive half cycle 50 as determined by the forcing function of the EM motor rotation as shown in FIG. 9A, the eccentric mass motor 10 rotates such that the reaction force on the mechanical contactor 22 moves forward depressing the mechanical contactor 22 from its neutral position further into the skin (not shown). On the negative half-cycle illustrated in FIG. 9C, the mechanical contactor 22 pulls away from the skin until it reaches its fully retracted state 52. During these cycles, the housing, acting as the reaction mass, moves in the opposite direction to the contactor, with reduced amplitude.

The drive signal depends on the design of the EM motor 10. In some cases, the drive signal is typically a DC voltage (or a pulse width modulated DC waveform). A particular problem, however, with DC motors is the slow rise time associated with its start up characteristics. This problem can be resolved in part using pre-compensated drive voltage waveforms and increasing the voltage and motor torque at start up. An alternative approach is to keep the EM motor 10 rotating at slow angular velocity at periods when the vibrotactile transducer 20 is intended to be off. This has the effect of avoiding motor startup delays and the effects of stiction in the mechanical system. Operating the vibrotactile transducer 20 at low frequencies (below the device characteristic resonance as illustrated in FIGS. 8A-B) may cause a vibrational stimulus that is below the threshold for detection by a user's body. It may therefore be preferable to maintain the rotation of the EM motor 10 and the transducer actuator output at below 20 Hz in periods where the vibortactile transducer 20 is to be "off." The EM motor 10 can then be rapidly (with minimal rise-time) accelerated to a higher frequency for periods where vibrational actuation is desired. This configuration therefore avoids start-up delays and the high starting torque requirements required for DC motors. Since the EM motor is continuously on, some reduction in overall system efficiency is expected. This can also be minimized by using a controller that has various modes where the EM motor rotates during periods corresponding to vibrotactile activity and kept in power saving/off mode during longer periods of inactivity.

Figure 10:
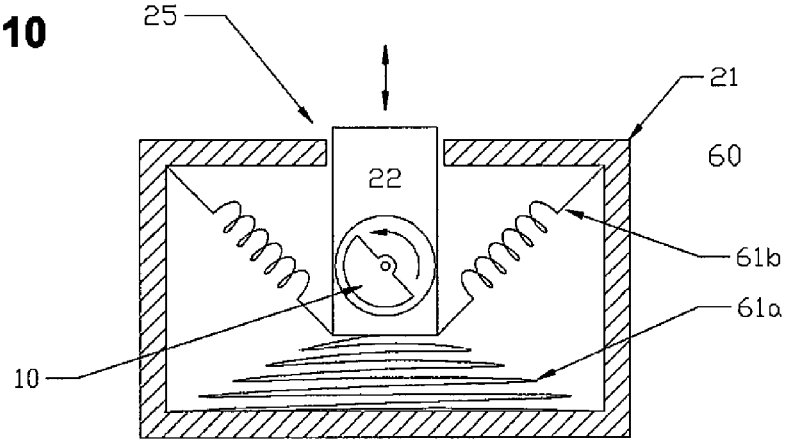
FIG. 10 illustrates an embodiment of a vibrotactile transducer using a coil spring as the compliant element according to aspects of the present invention.

FIG. 10 illustrates an embodiment of a vibrotactile transducer 60 that employs a tapered concentric spring 61*a/b* according to aspects of the present invention. In particular, a tapered spring 61*a/b* is used as a centering element and used to guide the motor/contactor assembly in the linear motion. The contactor 22 thus vibrates perpendicular to the body surface (not shown). The required transducer spring constant is provided by one or more coil springs 61*a* and 61*b*. A single spring embodiment is also possible where spring 61*b* is omitted, and its compliance is effectively replaced by the compliance of the body surface when the vibrotactile transducer 60 is held in contact with the body surface.

Figure 11:
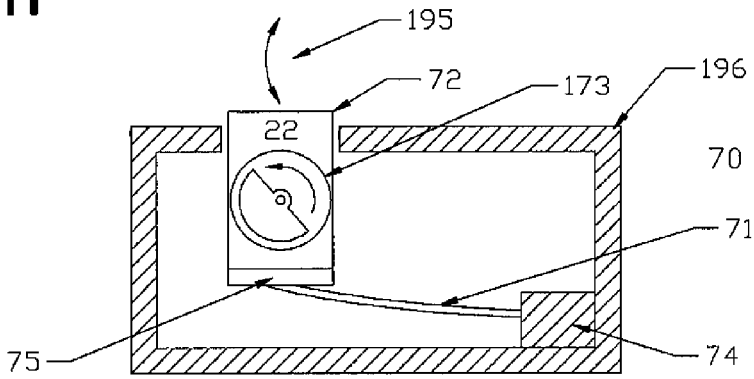
FIG. 11 illustrates an embodiment of a vibrotactile transducer using a cantilever spring as the compliant element according to aspects of the present invention.

FIG. 11 illustrates an embodiment of a vibrotactile transducer 70 that employs a cantilever offspring 71 according to aspects of the present invention. A cantilever spring 71, as described in FIGS. 6A-D, is used to center and a guide for the contactor 22. The EM motor 173 rotates and produces inertial forces that act upon the contactor 22. A vibrotactile transducer 70 includes a housing that contains the contactor 22 and spring 71. The cantilever spring 71 is clamped on one end by a housing fixture 74 and on the other end by a fixture 75 at the contactor 22. The contactor 22 vibrates in a motion 195 approximately perpendicular to the body surface (not shown). The front contacting surface 72 of the contactor 22 acts on the load associated with the body surface. The front contacting face 196 of the housing as well as the front contacting face 72 of the contactor 22 may be in simultaneous contact with the body surface.

Figure 12:
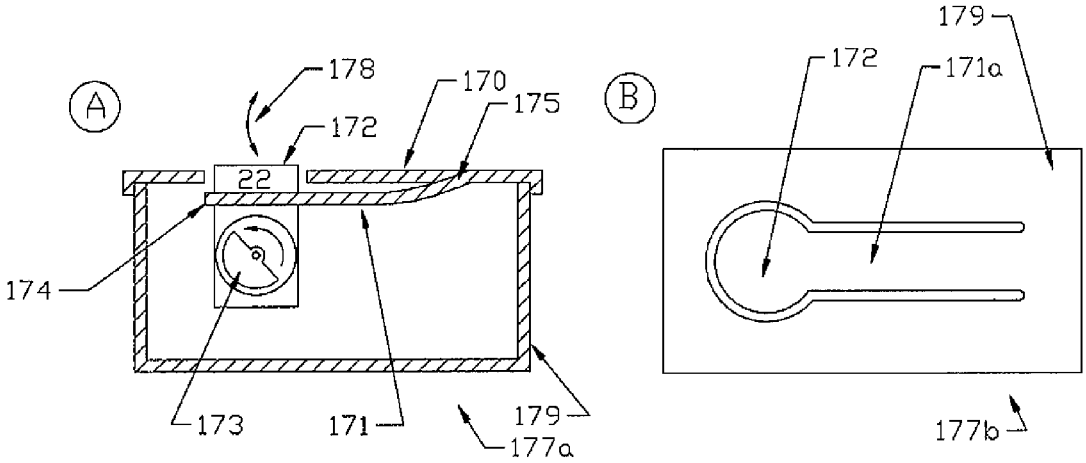
FIGS. 12A-B illustrate another embodiment of a vibrotactile transducer using a spring according to aspects of the present invention.

FIGS. 12A-B illustrate two views of an embodiment of a vibrotactile transducer that employs a spring 171. The spring 171 centers, and acts a guide for, contactor 22. A housing 179 contains the contactor 22 and the spring 171. The spring 171 forms a part of a contacting front face 170 of the housing 179, but is cut-out, pressed and recessed from the front face 170. The spring 171 forms part of the housing 179 at one end 175 and is clamped on the other end by a fixture 174 at the contactor 22. The EM motor 173 rotates and produces inertial forces that act upon the contactor 22. The contactor assembly vibrates in a motion 178 approximately perpendicular to the body surface (not shown). A front contacting surface 172 of the contactor 22 acts on the load associated with the body surface. A front contacting face 179 of the housing and the front contacting face 172 of the contactor 22 may be in simultaneous contact with the load. The front contacting face 179 also protects the recessed spring front surface 171*a* from any damping from the load from the body surface.

Figure 13:
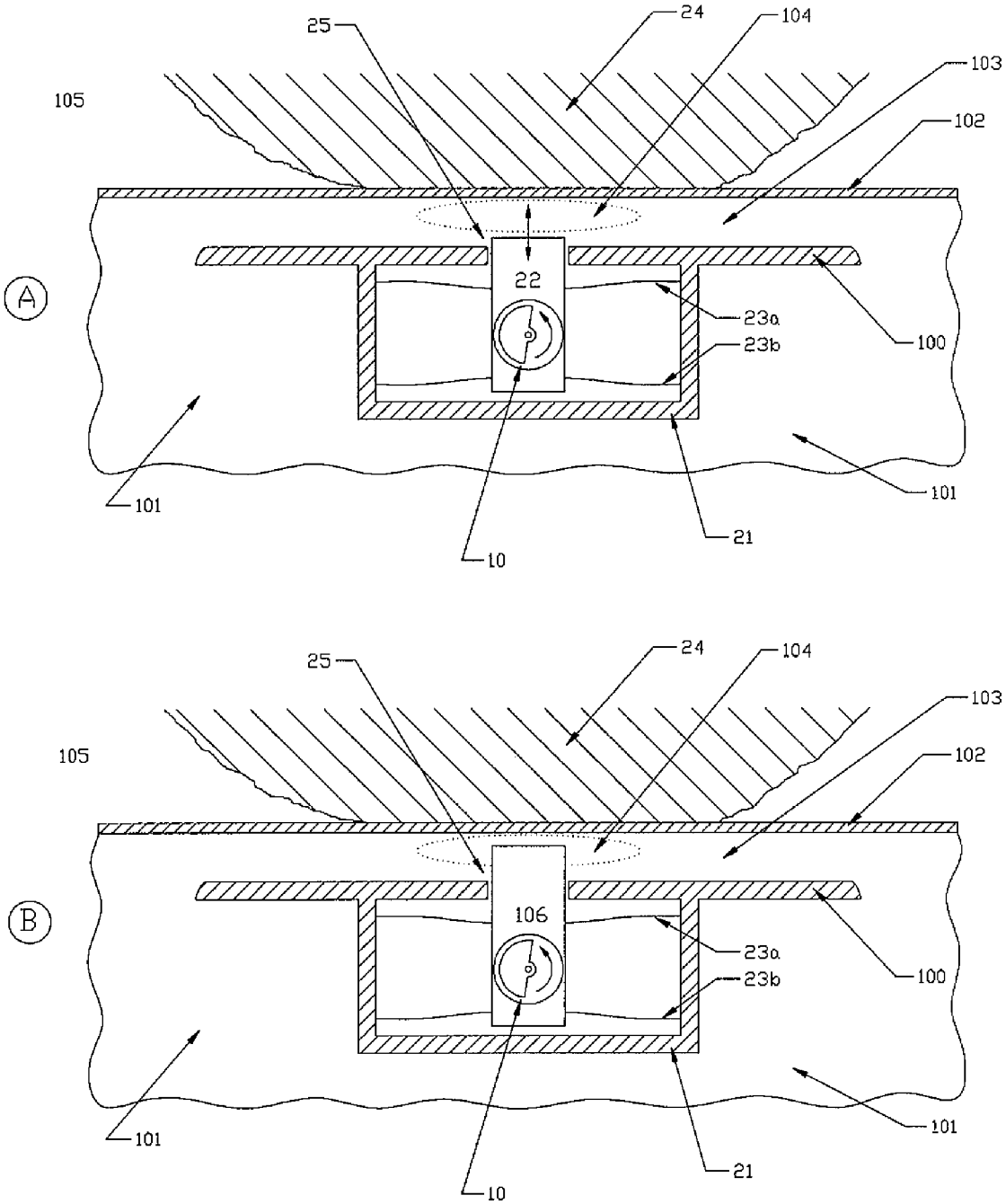
FIGS. 13A-B illustrate an embodiment of a seat mounted vibrotactile transducer according to aspects of the present invention.

FIGS. 13A-B illustrates an embodiment of a system 105 that is mounted in a seat according to aspects of the present invention. The front contacting surface 100 of the housing 21 is anchored in a padding 101. The padding 101 may be a viscous foam typically used in seats found in motor cars, aircraft, and many other vehicles. In this embodiment, the overall transducer weight may not be as critical as in wearable embodiments. Indeed, it may be preferable to employ a larger housing 21 for the vibrotactile transducer and a larger EM motor 10. The padding 101 provides damping in the system. The system 105 provides a contactor 22 that efficiently concentrates the displacement over a narrow area depicted by 104. As such, the drive force of EM motor 10 is applied via the contactor 22 to the intended body surface. The load may be associated with the body surface 24 (including any possible intermediate clothing) adjacent to a seat covering 102 and a padding area 103 of the padding 101.

As shown in FIG. 13A, the vibrotactile transducer with a contactor 22 is mounted relatively deeply in the padding 101. The selection of the EM motor 10, the front contacting face 100, the housing mass, the front contacting face of the contactor 22, the mass of the contactor 22, and suspension spring compliance 23*a* and 23*b* follows the analysis of the free body diagram described in FIG. 5. In some embodiments, the front contacting face of the contactor 22 is less than 2 cm in diameter. However, the load impedances $Z_1$ and $Z_2$ include the additional effect of the padding 101. The padding 101 acts as a viscous damping load on a large housing area. In addition to the load from the body surface 24, the mass and stiffness associated with the seat materials contributes to the total mechanical load impedance.

In some embodiments, an elongated mechanical contactor 106 may be employed. As shown in FIG. 13B, the contactor 106 may extend beyond the front contacting face 100 of the housing 21. As such, the contactor 106 is in closer proximity to the body surface 24. This is beneficial in situations where the thickness of intermediate padding 104 is also minimized to increase the perception of the tactile stimulus.

Figure 14:
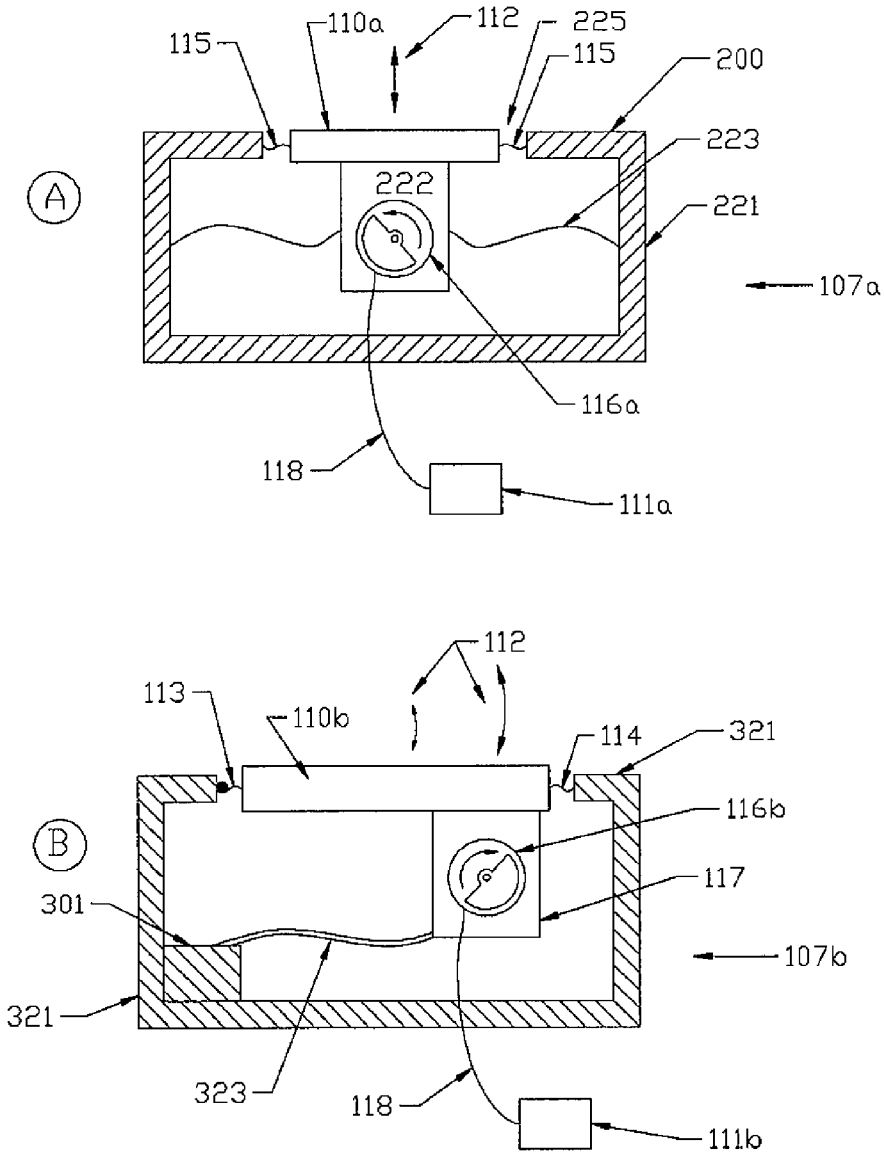
FIGS. 14A-B illustrate embodiments of vibrotactile transducers employing a push button and touch screen according to aspects of the present invention.

FIGS. 14A-B illustrate haptic embodiments 107*a* and 107*b* according to aspects of the present invention. In FIG. 14A, a push button 110*a* has been configured as a haptic display. The push button 110A is mounted within a housing 221, and connected to the front contacting face 200 of the housing 221 via a suspension 115. This suspension 115 covers the gap 225 between the push button 110A and the housing face 200. An end of the push button 110A is mounted against a contactor 222 containing an EM motor 116*a*. The EM motor 116*a* is coupled to a suitable controller 111*a* by wire leads 118. The assembly is held within the housing 221 by a spring configuration 223. The rotation of the EM motor 116*a* causes the face of the push button 110*a* to become displace in response to signals from the controller 111A. The compliance of springs 223, contactor mass (including the mass of the motor housing as well as the push button 110*a*), and the mass of the housing 221 mass may be configured in accordance with the load impedance (usually a skin load and skin mechanical impedance) and the desired output vibratory characteristics. In one embodiment, the compliance of the springs 223 is configured such that the system operates at or above resonance. In this case, the push button 110*a* actuates with approximately constant force across a wide range of operating angular frequencies. Therefore a wide range of haptic stimuli may be delivered to users, e.g., through the user's finger tips.

It may be desirable for haptic touch screen displays to convey a wide bandwidth stimulus in response to a users touch and interactive user interface with a screen or similar display device. FIG. 14*a* illustrates a touch screen 110*b* mounted in a housing 321. One (or both) sides of the screen 110*b* are attached to the front contacting face of the housing 321, e.g., a cellular phone, PDA, or similar device, with a suspension 114. The suspension 114 acts to seal the housing and also to hold the screen in place. In some configurations, it may be desirable to attach one side of the touch screen 110*b* to the front contacting face of the housing 321 using a hinge 113. A wide bandwidth EM motor 116*b* is attached to the screen 110*b* within a contactor housing 117. The EM motor 116*b* is driven by a suitable controller 111*b* that may be coupled to the EM motor 116*b* by wire leads 118. A spring configuration 323 may be employed to mount the contactor 117 to the housing 321. The spring configuration 323 may be clamped to the housing 321 using a fixture 301. The compliance of the spring configuration 323, the mass of the contactor 117 (including the mass of the motor housing as well as the screen 110*b*), and the mass of the housing 321 may be configured in accordance with the load impedance (usually a skin load and skin mechanical impedance) and the desired output vibratory characteristics. In one embodiment, the compliance of the springs 323 is configured such that the system operates at or above resonance. In this case, the touch screen 110*b* actuates with approximately constant force across a wide range of operating angular frequencies. The vibration 112 of the display surface is delivered to a user who is in contact with the display. Therefore, a wide range of haptic stimuli and tactile display effects may be conveyed to the users, e.g., through the user's finger tips.

Figure 15:
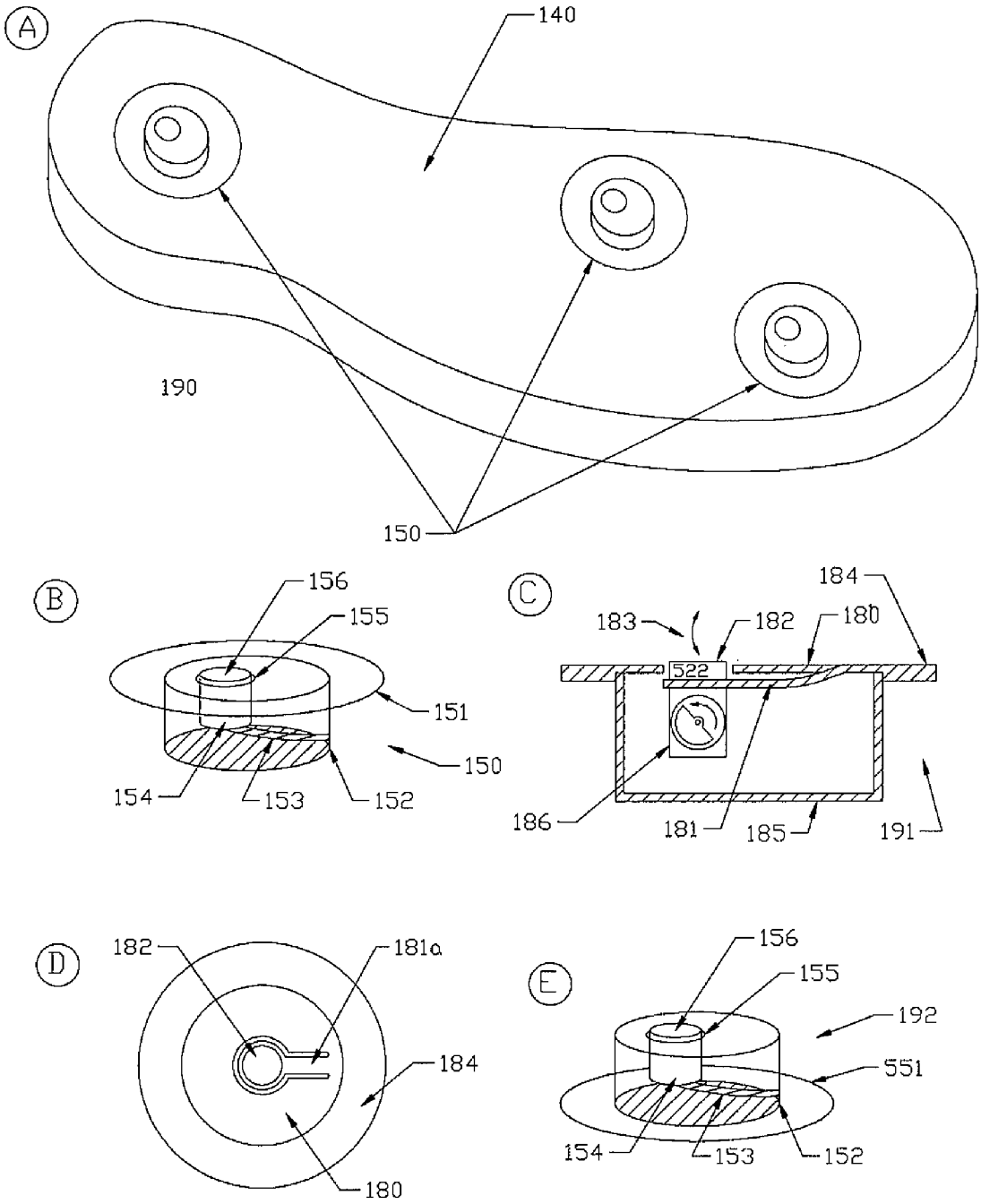
FIGS. 15A-E illustrate an alternative embodiment according to aspects of the present invention, including configurations suitable for mounting within the insole of a shoe.

FIGS. 15A-E illustrate an embodiment 190 that mounts a vibrotactile transducer the insole or sole of a shoe according to aspects of the present invention. Stochastic resonance can enhance the functionality of sensory cells, as described, for example, in U.S. Pat. Nos. 5,782,873 and 6,032,074. It may be beneficial to implement sensory cell enhancement in a wide variety of subjects including patients with various balance disorders (such as peripheral neuropathy). A limitation in conventional systems has been the lack of suitable transducers to generate vibratory displacements on the sole of the subjects feet. Preferably, compact vibrotactile transducers 150 for the embodiment 190 are wide band, e.g., about 50-100 Hz. The transducer force is generally unaffected by the loading. The subject loads the sole of the shoe and the transducer with a variable weight depending on the gait, posture and movement. FIG. 15A illustrates a sole of a shoe 140. A number of vibrotactile transducers 150 are distributed over the lateral surface of the shoe 140. FIG. 15B shows a detailed view of the vibrotactile transducer 150. An EM motor/contactor assembly 154 is attached via a spring (or combination of springs) 153 to a housing 152. The housing 152 contains the spring 153 and motor/contactor assembly 154. The front contacting face 156 of the motor/contactor assembly 154 may protrudes slightly from the housing 152 with a radial gap 155 surrounding the motor/contactor assembly 154. The front contacting face 151 of the housing 152 has a flange. Both the front contacting face 151 of the housing 152 and the front contacting face 156 of the motor/contactor assembly 154 may be in contact with the load. The load may be separated from the subject by a thin flexible material such as a silicon gel or foam layer. This layer can act to transmit the vibration over the complete lateral area of the sole and introduces some additional damping. It may be desirable to increase the flange area of the front contacting face 151 to control this damping. The mass of the motor/contactor assembly, housing, the spring characteristics, and the front contacting faces are configured such that the mechanical resonance is at or below 50

Hz and that the transducer operates primarily above this resonant frequency (in the region where the displacement response is relatively flat).

FIGS. 15C-D illustrate an alternative vibrotactile transducer 191 suitable for operation and mounting within the sole of a shoe. The vibrotactile transducer 191 uses a single cantilever spring 181. The spring 181 forms part of the front contacting face 180 of the housing 185 but is cut-out and recessed from the front face 180. The spring 181 and motor/contactor assembly 522 are surrounded by a housing 185. A EM motor 186 rotates and produces inertial forces that act upon the motor/contactor assembly 522. The spring 181 forms part of the housing on one end and is clamped on the other end by a fixture on the motor/contactor assembly 522. The motor/contactor assembly 522 vibrates in a motion 183 approximately perpendicular to the body surface (not shown). A housing 185 contains the motor/contactor assembly 522 and the spring 181. The front contacting face 182 of the motor/contactor assembly 522 acts on the load. The front contacting face 180 of the housing 185 and the front contacting face 182 of the motor/contactor assembly 522 may be in simultaneous contact with the load. The front surface 181*a* of the spring 181 is recessed relative to the front contacting face 180 of the housing 185 and therefore protected from loading effects. The mounting and operation of the vibrotactile transducer 191 may be enhanced by using a flange 184 extending from the front contacting face 180 of the housing 185. The flange 184 increases the equivalent housing mass and may be configured to control the damping due to the adjacent shoe sole material and its effect on the moving motor/contact assembly 522.

FIG. 15E illustrates an alternative vibrotactile transducer 192 that is also suitable for mounting within the sole of a shoe. In this case, the housing flange 551 is placed at the rear of the housing 152. This may be advantageous for mounting the transducer within the shoe from the underside of the shoe. The mass of the motor/contactor assembly 156, the housing 152, and the characteristics of the spring 153, and front contacting faces are chosen such that the mechanical resonance is at or below 50 Hz and that the transducer operates primarily above this resonant frequency (in the region where the displacement response is relatively flat as explained hereinbefore).

Controller electronics (not shown) are designed to drive the EM motor such that the vibrotactile transducer described in this embodiment produces a pseudo random band limited noise vibration displacement (when in contact with the load). In some embodiments, a noise spectrum in the range 50-120 Hz is well suited for providing suitable stimulus for sensory enhancement applications.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Therefore, the above description and illustrations should not be construed as limiting the scope of the invention, which is defined by the appended claims.

What is claimed is:

1. A transducer to provide a vibrational stimulus to a load in response to an electrical input, the transducer comprising; a housing having a contacting face and an opening in the contacting face; a contactor; at least one spring coupling the contactor to the housing and guiding motion of the contactor in the housing; and at least one eccentric mass motor coupled to the contactor, wherein when the contactor is pressed against the load, the contactor is displaced with respect to the housing to pre-load the contactor against the action of the at least one spring, and in response to receiving an electrical control input, the at least one eccentric mass motor produces inertial forces that vibrate the contactor between a retracted position within the housing and an extended position through the opening, and a compliance corresponding to the at least one spring results in a flat displacement response by the contactor while the contactor operates at or above a resonance associated with the housing, the contactor, the at least one spring, and a load mechanical impedance.

2. The transducer of claim 1, wherein the contactor is separated from the opening by a radial gap.

3. The transducer of claim 1 wherein the at least one spring guides motion of the mechanical contactor to predominantly perpendicular motion with respect to the contacting face.

4. The transducer of claim 1, wherein the at least one spring comprises at least one leaf spring.

5. The transducer of claim 1 wherein the at least one spring comprises at least one cantilever spring.

6. The transducer of claim 1 wherein the at least one spring comprises at least one spring that is formed from the contacting face.

7. The transducer of claim 1 wherein the at least one spring comprises at least one spiral spring.

8. The transducer of claim 1 wherein the at least one spring comprises a combination of spiral and leaf springs.

9. The transducer of claim 1 wherein the at least one spring comprises a combination of wire springs.

10. The transducer of claim 1 wherein the compliance of the spring is chosen to be resonant with the mass of the housing, the mechanical contactor and the load.

11. The transducer of claim 1 wherein the housing includes a flange extending beyond the housing.

12. A method for providing a wide band vibrational stimulus to a load in response to an electrical input, the method comprising: providing a vibrotactile transducer comprising a housing having a contacting face with an opening, a contactor, at least one eccentric mass motor, and at least one spring, the at least one spring suspending the contactor in the housing allowing the contactor to extend through the opening; pressing the contacting face against a body surface so that the contacting face and the contactor are initially in simultaneous contact with the body surface and the contactor is displaced with respect to the housing to pre-load the contactor against the action of the at least one spring, the body surface corresponding with a load; actuating the at least one eccentric mass motor to impart a vibrational stimulus to the body surface; and controlling electrical control input to the eccentric mass motor, such that rotation and resultant inertial forces from the eccentric mass motor are at a rate equal to or greater than a mechanical resonance associated with the contactor, the at least one spring, the housing, and a load mechanical impedance.

13. The method of claim 12 such that the vibration of the mechanical contactor is substantially in a plane that is normal to the body surface.

14. The method of claim 12 wherein the at least one spring guides motion of the contactor along a plane that is normal to the contacting face.

15. The method of claim 12 further including the step of controlling resonance of the transducer within the band of about 5-300 Hz.

16. The method of claim 12 wherein the vibrotactile transducer is mounted within a seat.

17. The method of claim 12 wherein the vibrotactile transducer is mounted within a shoe.

18. The method of claim 12 wherein the vibrotactile transducer is mounted within a push button.

19. The method of claim 12 wherein the vibrotactile transducer is mounted within a display screen.

20. The method of claim 12 further comprising controlling the electrical control input to the eccentric mass motor during periods intended to convey no vibration, such that the rotation and resultant inertial forces from the eccentric mass motor are at a rate less than the mechanical resonance associated with the contactor, the at least one spring, the housing, and the load mechanical impedance.

* * * * *